US009181943B2

(12) United States Patent
Blackson

(10) Patent No.: US 9,181,943 B2
(45) Date of Patent: Nov. 10, 2015

(54) METHOD FOR SYNCHRONIZING LINEAR PUMP SYSTEM

(75) Inventor: Christopher R. Blackson, Uniontown, OH (US)

(73) Assignee: Graco Minnesota Inc., Minneapolis, MN (US)

( * ) Notice: Subject to any disclaimer, the term of this patent is extended or adjusted under 35 U.S.C. 154(b) by 230 days.

(21) Appl. No.: 13/814,093

(22) PCT Filed: Aug. 19, 2011

(86) PCT No.: PCT/US2011/001460

§ 371 (c)(1),
(2), (4) Date: Feb. 4, 2013

(87) PCT Pub. No.: WO2012/023987

PCT Pub. Date: Feb. 23, 2012

(65) Prior Publication Data

US 2013/0142672 A1 Jun. 6, 2013

Related U.S. Application Data

(60) Provisional application No. 61/375,265, filed on Aug. 20, 2010.

(51) Int. Cl.
*F04B 49/12* (2006.01)
*F04B 9/113* (2006.01)
(Continued)

(52) U.S. Cl.
CPC ..... *F04B 49/12* (2013.01); *F04B 9/113* (2013.01); *F04B 13/00* (2013.01); *F04B 23/00* (2013.01); *F04B 23/06* (2013.01); *F04B 49/065* (2013.01)

(58) Field of Classification Search
CPC ..... F04B 23/06
See application file for complete search history.

(56) References Cited

U.S. PATENT DOCUMENTS 3,902,318 A 9/1975 Becker et al.
3,908,862 A 9/1975 Chandra et al.
(Continued)

FOREIGN PATENT DOCUMENTS

CN 101708440 A 5/2010
EP 0225604 A2 6/1987
(Continued)

OTHER PUBLICATIONS

International Search Report and Written Opinion from PCT Patent Application Serial No. PCT/US2011/001460, mailed Mar. 16, 2012, 10 pages.
(Continued)

*Primary Examiner* — Charles Freay
*Assistant Examiner* — Kenneth J Hansen
(74) *Attorney, Agent, or Firm* — Kinney & Lange, P.A.

(57) ABSTRACT

A method for synchronizing pistons within linear pumps of a variable dispense ratio system comprises operating first and second pistons, controlling the first and second pistons, and reversing direction of one of the first and second pistons. The first and second pistons are operated within first and second cylinders so that the first piston moves at a slower speed than the second piston to produce a variable dispense ratio. The first and second pistons are controlled to reverse directions whenever one piston reaches an end of its respective cylinder to produce pumping. One of the first and second pistons reverses direction before either piston reaches an end of its respective cylinder to adjust the synchronicity of the pistons.

27 Claims, 7 Drawing Sheets

(51) Int. Cl.

| | |
|---|---|
| ***F04B 13/00*** | (2006.01) |
| ***F04B 23/06*** | (2006.01) |
| ***F04B 49/06*** | (2006.01) |
| ***F04B 23/00*** | (2006.01) |

(56) References Cited

U.S. PATENT DOCUMENTS

| | | | | | |
|---|---|---|---|---|---|
| 4,008,829 | A | * | 2/1977 | Chandra et al. | 222/63 |
| 4,090,695 | A | * | 5/1978 | Stone et al. | 366/76.2 |
| 4,167,236 | A | | 9/1979 | Taubenmann | |
| 4,209,258 | A | | 6/1980 | Oakes | |
| 4,304,527 | A | * | 12/1981 | Jewell et al. | 417/102 |
| 4,494,676 | A | * | 1/1985 | Berweger | 222/63 |
| 4,881,820 | A | | 11/1989 | Luckhoff | |
| 4,919,595 | A | | 4/1990 | Likuski et al. | |
| 4,990,058 | A | | 2/1991 | Eslinger | |
| 5,151,015 | A | | 9/1992 | Bauer et al. | |
| 5,294,052 | A | | 3/1994 | Kukesh | |
| 5,305,923 | A | | 4/1994 | Kirschner et al. | |
| 5,381,926 | A | | 1/1995 | Credle, Jr. et al. | |
| 5,971,714 | A | | 10/1999 | Schaffer et al. | |
| 6,161,956 | A | | 12/2000 | Jerkel | |
| 6,227,807 | B1 | | 5/2001 | Chase | |
| 6,286,566 | B1 | | 9/2001 | Cline et al. | |
| 2001/0031212 | A1 | * | 10/2001 | Anderson et al. | 417/539 |
| 2002/0141875 | A1 | | 10/2002 | Carstensen | |
| 2004/0001765 | A1 | | 1/2004 | Wood | |
| 2007/0196219 | A1 | * | 8/2007 | Hofling et al. | 417/347 |
| 2009/0280034 | A1 | | 11/2009 | Ballu | |

FOREIGN PATENT DOCUMENTS

| | | | |
|---|---|---|---|
| EP | 2436925 | A1 | 4/2012 |
| JP | 2004517014 | A1 | 6/2004 |
| JP | 2007263001 | A | 10/2007 |
| WO | WO 98/25570 | A1 | 6/1998 |

OTHER PUBLICATIONS

Graco DC12 Tandem Pump Option Operations Manual, Published Jun. 2008.

State Intellectual Property Office of People's Republic of China, First Office Action, Dec. 3, 2013, 6 pages.

* cited by examiner

BEFORE ADJUST

NORMAL REVERSAL & SENSE POSITION

SYNCH REVERSAL

SYNCH REVERSAL

NORMAL REVERSAL

NORMAL REVERSAL

BEFORE ADJUST

NORMAL REVERSAL & SENSE POSITION

SYNCH REVERSAL

NORMAL REVERSAL

NORMAL REVERSAL

NORMAL REVERSAL

METHOD FOR SYNCHRONIZING LINEAR PUMP SYSTEM

BACKGROUND

The present invention relates generally to pump control systems. More particularly, the present invention relates to synchronizing pistons in linear pumps systems.

Linear pumps include a piston that reciprocates in a housing to push fluid through the housing. Conventional linear pumps draw fluid into the housing on a backward stroke and push the fluid out of the housing on a forward stroke. Valves are used to prevent backflow through the pump. The valves can also be configured to draw in fluid and pump fluid on opposite sides of the piston during each of the backward stroke and forward stroke in order to provide a steady flow of fluid from the pump. Furthermore, typical linear pump systems utilize two linear pumps of the same construction. For example, a resin material and a catalyst material are simultaneously pumped to a mixing head of a dispensing unit. Such systems require precisely metered flow so that the proper mixture of resin and catalyst is always obtained. Mixing of the two materials produces a chemical reaction that begins a solidification process resulting in a hardened material after full curing. The resin and catalyst are not always dispensed in a 1:1 ratio such that the speeds of the pumps are the same, assuming the pumps are mechanically identical. For example, typically a 2:1 dispense ratio is used where a first pump operates the piston at speeds twice as fast as a second pump.

It is desirable that the pumps maintain synchronization such that the mix ratio is maintained. In order to do so, is necessary that the pumps reverse direction at the same time while maintaining the same speed ratio, which results in one piston using a longer stroke length than the other. Synchronization of the pumps drifts during typical operation of the linear pump system for various reasons. For example, the speeds of the pumps need to be adjusted slightly between forward strokes and backward strokes due to small differences between the effective piston surface areas in each direction. When the pistons are not properly synchronized, excessive piston reversals degrade component quality and increase pump wear. There is, therefore, a need for maintaining synchronization between pumps in linear pump systems.

SUMMARY

The present invention is directed to methods for synchronizing pistons within linear pumps of a variable dispense ratio system. The methods comprise operating first and second pistons, reversing direction of the first and second pistons, and reversing direction of one of the first and second pistons. The first and second pistons are operated within first and second cylinders so that the first piston moves at a slower speed than the second piston to produce a variable dispense ratio. The first and second pistons are controlled to reverse directions whenever one piston reaches an end of its respective cylinder to produce pumping. One of the first and second pistons reverses direction before either piston reaches an end of its respective cylinder to adjust the synchronicity of the pistons.

DETAILED DESCRIPTION

Figure 1A:
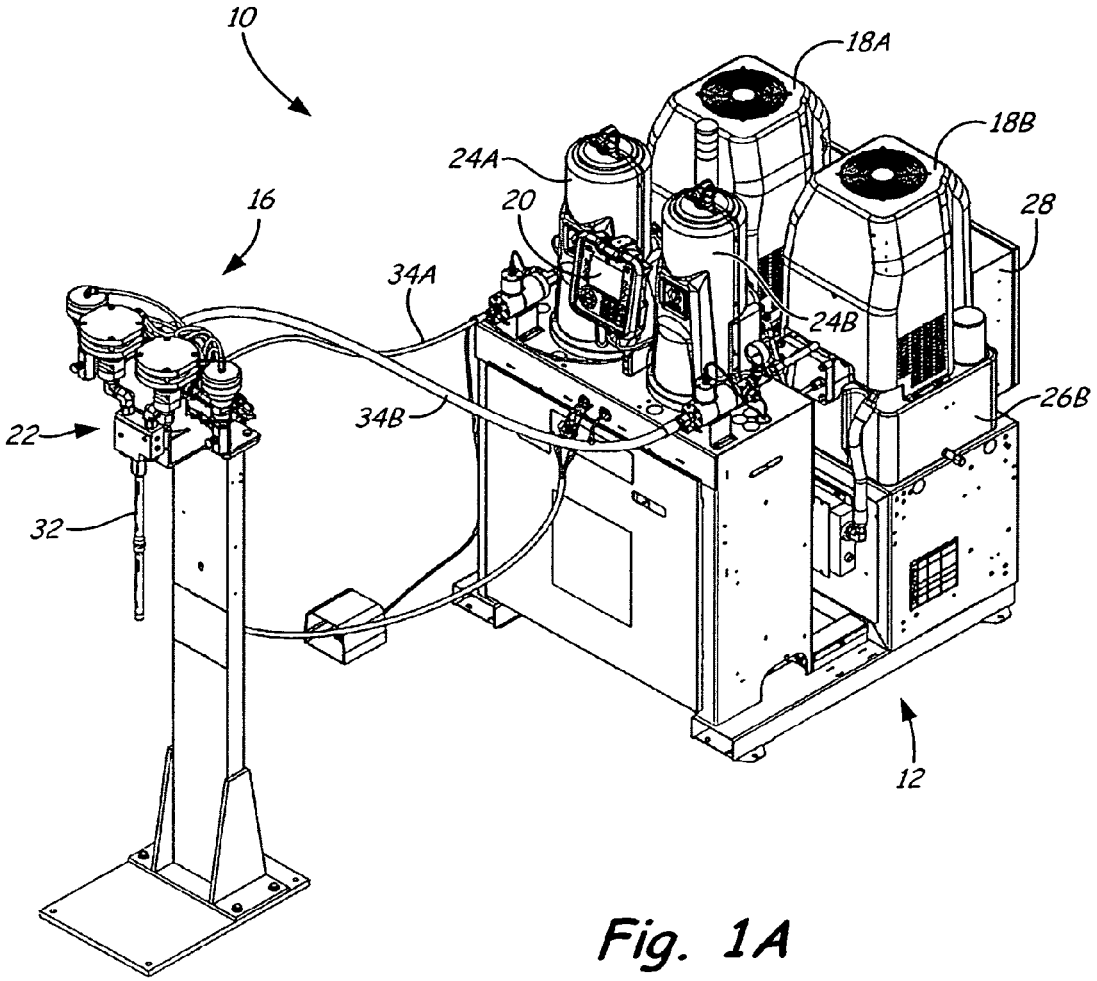
FIGS. 1A and 1B show a dual-component pump system having a pumping unit, component material containers and a dispensing unit.
Figure 1B:
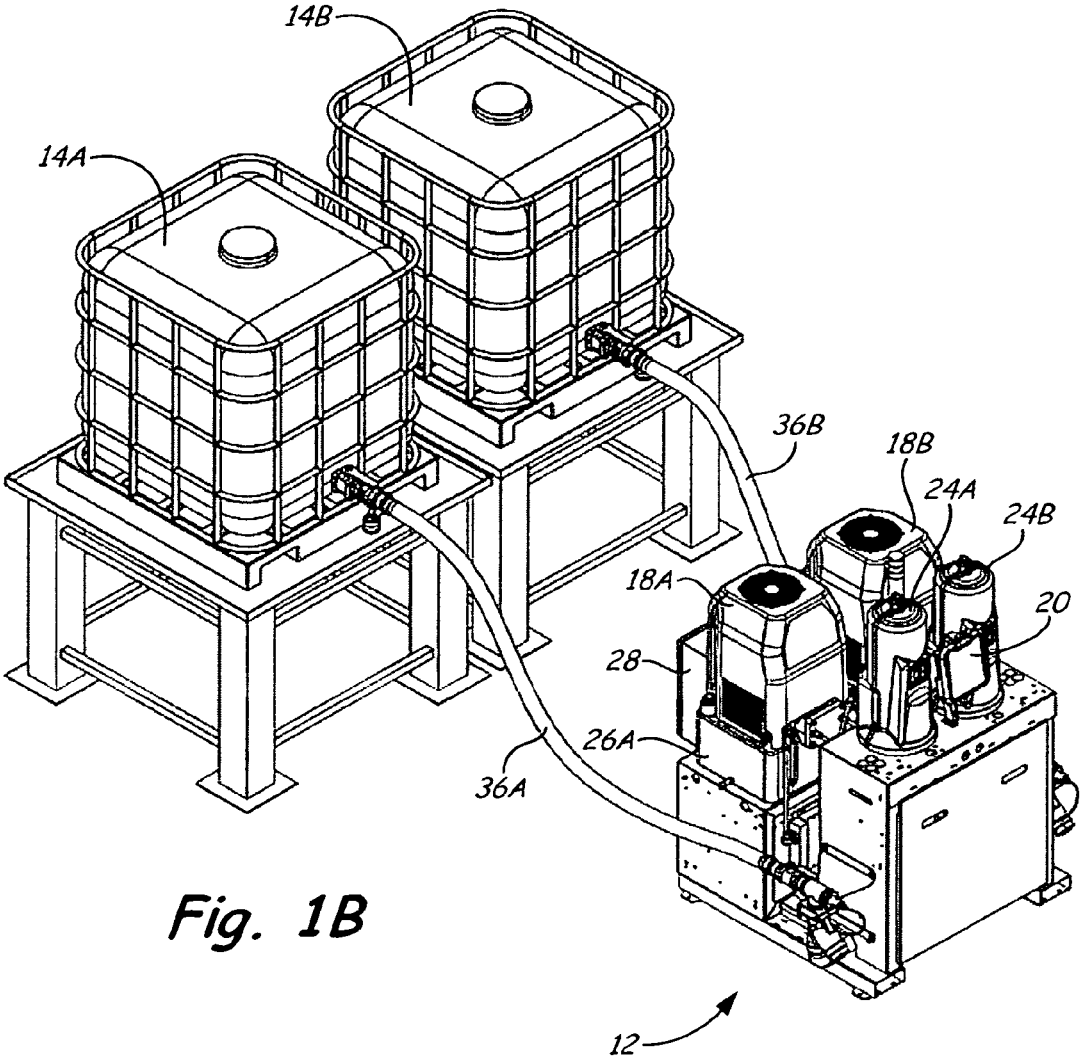
Figure 2:
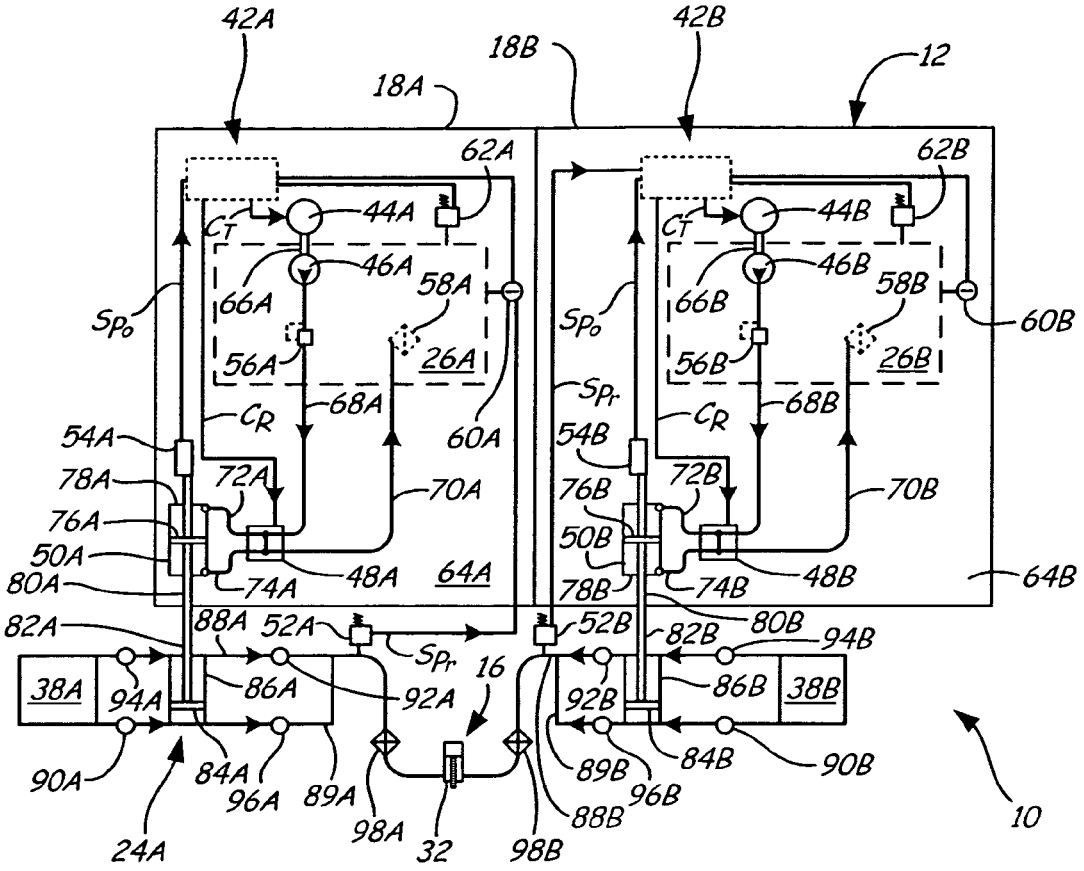
FIG. 2 shows a schematic of the dual-component pump system of FIGS. 1A and 1B having individually controlled linear component pumps.

FIGS. 1A and 1B show dual-component pump system 10 having pumping unit 12, component material containers 14A and 14B and dispensing unit 16. FIGS. 1A and 1B are discussed concurrently. Pumping unit 12 comprises hydraulic power packs 18A and 18B, display module 20, fluid manifold 22, first linear pump 24A, second linear pump 24B, hydraulic fluid reservoirs 26A and 26B and power distribution box 28. As shown in FIG. 2, an electric motor, a dual output reversing valve, a hydraulic linear motor, a gear pump and a motor control module (MCM) for each of linear pumps 24A and 24B are located within hydraulic power packs 18A and 18B. Dispensing unit 16 includes dispense head 32 and is connected to first linear pump 24A and second linear pump 24B by hoses 34A and 34B, respectively. Hoses 36A and 36B connect material containers 14A and 14B to linear pumps 24A and 24B, respectively. The present invention relates to control of pistons within cylinders of pumps 24A and 24B to optimize stroke of the pistons during operation.

Component material containers 14A and 14B comprise hoppers of first and second viscous materials that, upon mixing, form a hardened structure. For example, a first component comprising a resin material, such as a polyester resin or a vinyl ester, is stored in component material container 14A, and a second component comprising a catalyst material that causes the resin material to harden, such as Methyl Ethyl Ketone Peroxide (MEKP), is stored in component material container 14B. Electrical power is supplied to power distribution box 28, which then distributes power to various components of dual-component system 10, such as the MCMs within hydraulic power packs 18A and 18B and display module 20. Pumps 36A and 36B supply flows of the first and second component materials to linear pumps 24A and 24B, respectively. Linear pumps 24A and 24B are hydraulically operated by the gear pumps in hydraulic power packs 18A and 18B. The gear pumps are operated by the electric motors in power packs 18A and 18B to draw hydraulic fluid from hydraulic fluid reservoirs 26A and 26B and to provide pressurized hydraulic fluid flow to the dual output reversing valve, which operates the linear motor, as will be discussed in greater detail with reference to FIG. 2.

When a user operates dispense unit 16, pressurized component materials supplied to manifold 22 by linear pump 24A and linear pump 24B are forced to mixing head 32. Mixing head 32 blends the first and second component materials to begin the solidification process, which completes when the mixed component materials are dispensed into a mold, for example. The first and second component materials are typically dispensed from unit 16 at a constant output condition. For example, a user can provide an input at display module 20 to control the MCMs to dispense the component materials at a constant pressure or at a constant flow rate. The MCMs uses control logic inputs and outputs in conjunction with the electric motor and the dual output reversing valve, among other components, to provide the constant output condition by controlling speed and reversals of the pistons within pumps 24A and 24B. However, because linear pumps 24A and linear pump 24B include pistons that must reverse direction at different positions within their respective cylinders and that must operate at slightly different speeds to account for different effective piston surface areas, the pistons have a tendency to drift out of coordinated operation to dispense the component materials in the desired ratio. Specifically, pumps 24A and 24B include pistons that operate in a synchronous manner, where the pistons move in the same direction, or an anti-synchronous manner, where the pistons move in opposite directions. The present invention provides methods for synchronizing operation of pumps 24A and 24B either from a starting position or during sustained operation.

FIG. 2 shows a schematic of dual-component pump system 10 of FIGS. 1A and 1B having individually controlled linear component pumps 24A and 24B. Pump system 10 includes pumping unit 12, dispensing unit 16, first linear pump 24A, second linear pump 24B, first hydraulic fluid reservoir 26A, second hydraulic fluid reservoir 26B, motor control modules (MCMs) 42A and 42B, electric motors 44A and 44B, gear pumps 46A and 46B, dual output reversing valves 48A and 48B, hydraulic linear motors 50A and 50B, output pressure sensors 52A and 52B and velocity linear position sensors 54A and 54B. Hydraulic reservoirs 26A and 26B also include pressure relief valves 56A and 56B, filters 58A and 58B, level indicators 60A and 60B, and pressure sensors 62A and 62B, respectively.

Hydraulic fluid reservoir 26A, MCM 42A, electric motor 44A, gear pump 46A, dual output reversing valve 48A and hydraulic linear motor 50A are located within hydraulic power pack 18A and comprise first linear motor system 64A. Likewise, hydraulic fluid reservoir 26B, MCM 42B, electric motor 44B, gear pump 46B, dual output reversing valve 48B and hydraulic linear motor 50B are located within hydraulic power pack 18B and comprise second linear motor system 64B. In other embodiments of the invention, the linear motor systems share components, such as an electric motor, gear pump and hydraulic fluid reservoir.

With pumping unit primed and activated, pressurized first and second component materials are provided to linear pumps 24A and 24B. Linear pumps 24A and 24B are operated by first and second linear motor systems 64A and 64B to provide pressurized first and second component materials to dispensing unit 16. Also, pressurized air is provided to dispensing unit 16 to operate a pump or valve mechanism to release the pressurized component materials into mix head 32 and out of unit 16.

Linear motor systems 64A and 64B are controlled by motor control modules (MCM) 42A and 42B, respectively. MCMs 42A and 42B operate linear motor systems 64A and 64B so that disproportional amounts of component material are provided to dispensing unit 16. MCM 42A and MCM 42B are in communication with each other so that control logic can be coordinated to produce the desired dispense ratio. Description of the operation linear motor systems 64A and 64B will be directed to linear motor system 64A, with operation of linear motor system 64B operating in a like manner, with like components being numbered accordingly.

Electric motor 44A receives electric power from power distribution box 28 (FIG. 1A). In one embodiment, electric motor 44A comprises a direct current (DC) motor. MCM 42A issues torque command $C_T$, which is received by motor 44A to control the speed of drive shaft 66A. Drive shaft 66A is coupled to gear pump 46A, which is submerged in hydraulic fluid within hydraulic fluid reservoir 26A. Gear pump 46A utilizes the rotary input from motor 44A to draw in fluid from reservoir 26A and produce a flow of pressurized hydraulic fluid in line 68A. Hydraulic fluid reservoir 26A includes level indicator 60A, which is used to determine the amount of fluid within reservoir 26A. Pressure sensor 62A can be used to determine under-fill conditions within reservoir 26A. In other embodiments, drive shaft 66A is used to drive other types of positive displacement pumps that convert rotary input into pressurized fluid flow, such as rotary vane pumps or peristaltic pumps.

Pressurized hydraulic fluid from pump 46A flows past pressure relief valve 56A and to dual output reversing valve 48A. Relief valve 56A provides a means for allowing excess pressurized hydraulic fluid to return to reservoir 26A when excessive pressure conditions exists. As will be discussed below, reversing valve 48A uses the pressurized hydraulic fluid to reciprocate linear motor 50A. Pressurized hydraulic fluid returns to reservoir 26A from reversing valve 48A in line 70A after passing through filter 58A. Filter 58A removes impurities from the hydraulic fluid. Thus, a closed circuit flow of hydraulic fluid is formed between reservoir 26A, gear pump 46A, reversing valve 48A and linear motor 50A.

Dual output reversing valve 48A is constructed according to conventional reversing valve designs, as are known in the art. Dual output reversing valve 48A receives a continuous flow of pressurized hydraulic fluid and diverts the flow of fluid to linear motor 50A. Specifically, reversing valve 48A includes an input connected to line 68A, an output connected to line 70A and two ports connected to lines 72A and 74A. Pressurized fluid is alternately supplied to lines 72A and 74A, which is used to actuate linear motor 50A.

Linear motor 50A includes piston 76A, which slides within housing 78A between two fluid chambers. Each fluid chamber receives a flow of pressurized fluid from lines 72A and 72B, respectively. For example, with reversing valve 48A in a first position, line 72A provides pressurized fluid to a first chamber in housing 78A to move piston 76A downward (with respect to FIG. 2). Simultaneously, fluid within the other chamber in housing 78A is pushed out of linear motor 50A and back into reversing valve 48A through line 74A and out to line 70A. MCM 42A issues reverse command $C_R$, which is received by reversing valve 48A to control when linear motor 50A begins reversing direction. After reverse command $C_R$ is received, reversing valve 48A switches to a second position such that pressurized fluid is supplied to housing 78A through line 74A and fluid from housing 78A is removed through line 72A. Thus, operation of reversing valve 48A reciprocates piston 76A within housing 78A between two reversal positions, which also reciprocates output shaft 80A. Velocity linear position sensor 54A is coupled to shaft 80A and provides MCM 42A an indication of the position and speed of piston 76A based on the rate at which piston 76A is moving. In particular, position sensor 54A provides position signal $S_{Po}$ to MCM 42A when output shaft 80A is moving away from one of the reversal positions.

Output shaft 80A of linear motor 50A is directly mechanically coupled to piston shaft 82A of linear pump 24A. Shaft 82A drives piston 84A within housing or cylinder 86A. Piston 84A draws into housing 86A a component material from material container 14A. Linear pump 24A comprises a double action pump in which component material is pushed into line 88A on an up stroke (with reference to FIG. 2) and pushed into line 89A on a down stroke (with reference to FIG. 2). Specifically, on an up stroke, valve 90A opens to draw component material from material container 14A through manifold 22 (shown in FIG. 1A) and into housing 86A, and valve 92A opens to allow piston 84A to push material into dispensing unit 16 through line 88A, while valves 94A and 96A are closed. On a down stroke, valves 90A and 92A close, while valve 94A opens to draw component material from material container 14A through manifold 22 (shown in FIG. 1A) and into housing 86A, and valve 96A opens to allow piston 84A to push material into dispensing unit 16 through line 89A. The dual action of linear pump 24A maintains a continuous and near constant supply of component material during operation.

As mentioned, however, piston shafts 82A and 82B operate at different speeds to provide the desired mix ratio. Furthermore, the speed of each shaft is continuously adjusted by MCM 42A and 42B to account for differences in the effective area of pistons 84A and 84B between up-strokes and down-strokes. For example, the effective piston area is smaller on the upstrokes due to the presence of piston shafts 82A and 82B. Because housings 86A and 86B have the same length, the faster moving piston will utilize more of its housing than the other piston. The present invention maintains synchronous operation of piston shafts 82A and 82B by performing adjustments to the movements of the shafts based on the relative positions within cylinders 86A and 86B.

Component material from lines 88A and 89A is pushed into dispensing unit 16 by pressure from linear pump 24A, where it mixes with component material from linear pump 24B within mix head 32 before being dispensed from unit 16. Pressure sensor 52A senses pressure of the component material within line 88A and sends pressure signal $S_{Pr}$ to MCM 42A. Optional heater 98A can be attached to line 88A to heat the component material before dispensing from mix head 32 to, for example, reduce the viscosity of the component material or to facilitate reacting and curing with the other component material.

Piston shafts 82A and 82B are not mechanically coupled or tethered so that coordinated reversals of the shafts is maintained with MCM 42A and MCM 42B. MCM 42A receives position signal $S_{P}o$ and pressure signal $S_{Pr}$ and issues reverse command $C_R$ and torque command $C_T$. Using position signal $S_{P}o$ and pressure signal $S_{Pr}$, MCM 42A coordinates reverse command $C_R$ and torque command $C_T$ to control linear motor system at a constant output condition. For example, an operator of dual-component pump system 10 can specify at an input in display module 20 (FIG. 1A) that pumping unit 12 will operate to provide a constant pressure of the first and second component materials to manifold 22 (omitted from FIG. 2, shown in FIG. 1A) or a constant flow output of the component materials to manifold 22. MCM 42A operates control logic that continuously adjusts reverse command $C_R$ and torque command $C_T$ to maintain the constant output condition. Torque command $C_T$ determines how fast motor 44A rotates shaft 66A, which directly relates to how fast the chambers within housing 78A of linear motor 50A will fill with fluid. Reverse command $C_R$ determines when reversing valve 48A switches position. Issuance of reverse command $C_R$ is coordinated with how fast the chambers within housing 78A fill so that reversing valve 48A can switch the direction of fluid flow into housing 78A. The control logic maintains the speed of motor 44A and the switching rate of reversing valve 48A in concert to maintain the desired constant output condition. For example, because one of pistons 84A and 84B will run out of stroke length within housings 84A and 84B, respectively, before the other, MCM 42A and MCM 42B must issue reverse commands whenever one piston reaches the effective end of its cylinder. Ideally, the faster piston will engage an end of its cylinder first such that the entire stroke length of the housing is utilized, while the slower piston oscillates between ends of its housing without actually engaging either of the effective ends. However, as mentioned, the pistons can drift out of this arrangement, causing the slower moving piston to prematurely trigger a reversal in direction of the faster moving piston, reducing the stroke length of the faster moving piston.

Figure 3:
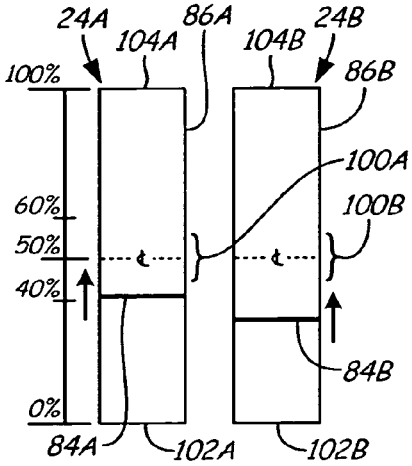
FIG. 3 shows starting positions for pistons of two linear pumps where the pistons are moving in the same direction within cylinders of the pumps.
Figure 4:
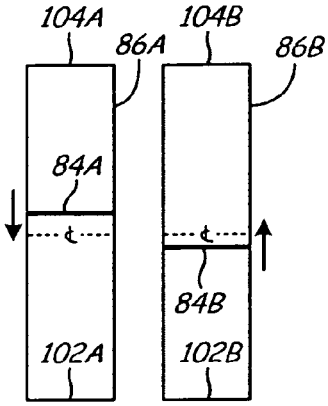
FIG. 4 shows starting positions for pistons of two linear pumps where the pistons are moving in opposite directions in central zones of the pumps.
Figure 5:
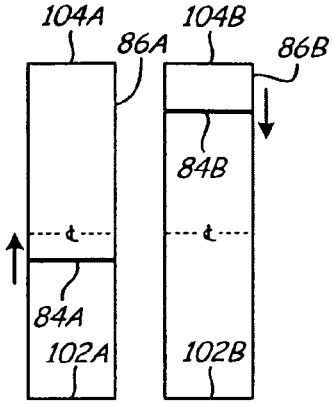
FIG. 5 shows starting positions for pistons of two linear pumps where the pistons are moving in opposite directions in different zones of the pumps.
Figure 6A:
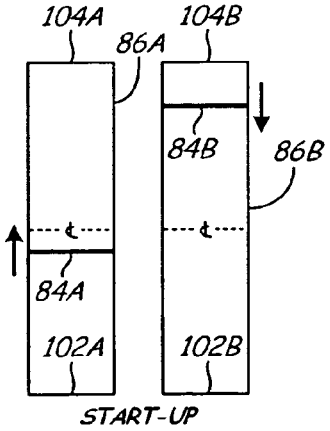
FIGS. 6A-6C show synchronizing procedures for synchronous starting of pumps having pistons moving in opposite directions in different zones of the pumps, as shown in FIG. 5.
Figure 6B:
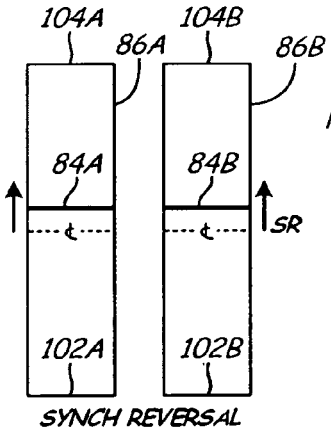
Figure 6C:
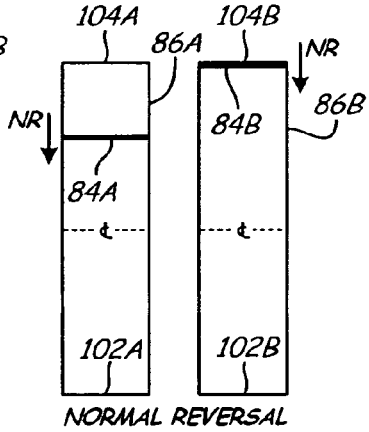

In addition to control logic, the present invention utilizes synchronizing logic to adjust operation of linear motor systems 64A and 64B and minimize disruption to timed, coordinated operation of piston shafts 82A and 82B, as will be discussed with reference to FIGS. 3-9F. FIGS. 3-5 show different starting positions of pistons 84A and 84B within cylinders 86A and 86B. FIGS. 6A-6C show procedures for initiating synchronous operation of pistons 84A and 84B from the starting position of FIG. 5. FIGS. 7A-7G and 8A-8F show procedures for synchronizing operation of pistons 84A and 84B while pumps 24A and 24B are already operating in synchronous and anti-synchronous modes, respectively. FIGS. 9A-9F show procedures for converting anti-synchronous operation to synchronous operation.

FIG. 3 shows starting positions for pistons 84A and 84B of linear pumps 24A and 24B where pistons 84A and 84B are prepared to move, or "pointing," in the same direction within cylinders 86A and 86B. Linear pump 24A comprises cylinder 86A in which piston 84A is driven by piston shaft 82A (not shown) of hydraulic linear motor 50A (FIG. 2). Linear pump 24B comprises cylinder 86B in which piston 84B is driven by piston shaft 82B (not shown) of hydraulic linear motor 50B (FIG. 2). Cylinders 86A and 86B include centerlines CL, which are surrounded by central zones 100A and 100B. Piston 84A is capable of reciprocating between ends 102A and 104A of cylinder 86A, while piston 84B is capable of reciprocating between ends 102B and 104B of cylinder 86B. Ends 102A, 102B, 104A and 104B represent the effective ends of cylinders 86A and 86B and thus pistons 84A and 84B do not necessarily engage or contact the actual ends of cylinders 86A and 86B. Cylinders 86A and 86B provide a 0% position and a 100% position for pistons 84A and 84B. In the described embodiment, central zones 100A and 100B extend from approximately the 40% position to approximately the 60% position. Also, for the purposes of the discussion of FIGS. 3-9F, linear pump 24B will be considered the major component pump such that piston 84B moves twice as fast as piston 84A for a 2:1 dispense ratio.

In order to arrange pistons 84A and 84B in the positions shown in FIGS. 3-5, MCM 42A and MCM 42B execute pre-dispense logic. The pre-dispense logic includes calculating pump velocities for both directions of travel of pistons 84A and 84B, calculating the distance between ends of cylinders 86A and 86B (i.e. stroke length), and calculating the effective surface area of pistons 84A and 84B for both directions of travel, all based on the type of materials to be dispensed and the desired flow rates based on volume or weight. The pre-dispense logic "points" pistons 84A and 84B in the "long direction" within each of cylinders 86A and 86B, as explained below, at the start of a dispense operation.

As shown in FIG. 3, piston 84A is within central zone 102A at the 40% position. Piston 84B is outside central zone 100B near end 102B. The pre-dispense logic prepares piston 84A for moving in an up stroke towards end 104A, and prepares piston 84B for moving in an up stroke towards end 104B. Because both pistons have over 50% of their respective cylinders remaining to travel, they are considered to be pointed in the "long direction" away from the "short direction." Such positions might represent how pistons 84A and 84B might be left after ceasing operation at a previous shut down of dual-component pump system 10, or after the previous dispense. Upon starting of system 10, it is necessary to synchronize the positions of pistons 84A and 84B for either synchronous or anti-synchronous operation of system 10. "Synchronous operation" means that pistons 84A and 84B are moving in the same direction, while "anti-synchronous operation" means that pistons 84A and 84B are moving in the opposite direction.

For synchronous operation, starting from the position of FIG. 3, both pistons 84A and 84B will move in the up direction, as indicated by arrows. Piston 84B will move twice a fast as piston 84A such that by the time piston 84B reaches end 104B, piston 84A will not yet have reached end 104A. When piston 84B reaches end 104B, MCM 42B will issue a reverse command to motor 50B, as happens under the control logic whenever any piston reaches an end under any operating conditions, such that piston 84B reverses direction. Additionally, as part of the control logic, MCM 42A will issue a reverse command to motor 50A such that piston 84A reverses direction at the same time as piston 84B. Subsequently, piston 84B will typically reach an end before piston 84A does, such that piston 84B has an opportunity to traverse nearly 100% of cylinder 86B, while piston 84A traverses 50% of cylinder 86A. Thus, pistons 84A and 84B can continue in synchronous operation and synchronization logic need not be executed by MCM 42A and MCM 42B.

For anti-synchronous operation, MCM 42A will initiate synchronization logic to induce pistons 84A and 84B to move in opposite directions, as they are starting movement in the same direction. MCM 42A issues a reverse command to piston 84A at some point before piston 84B reaches end 104B such that when piston 84B reaches end 104B, piston 84A will be directed to reverse direction in the opposite direction in which piston 104B reverses direction. Thus, piston 84A reverses direction at any point before piston 84B reaches end 104B to institute anti-synchronous operation.

FIG. 4 shows starting positions for pistons 84A and 84B of linear pumps 24A and 24B where pistons 84A and 84B are pointing in opposite directions in central zones 100A and 100B of cylinders 86A and 86B, respectively. In this scenario, pistons 84A and 84B are within central zones, but pointing in opposite "long" directions. This scenario presents the opposite conditions for the synchronization logic as compared to FIG. 3. To synchronize pistons 84A and 84B for anti-synchronous operation, the synchronization logic of MCM 42A and 42B need do nothing as piston 84B will reach end 104B before piston 84A reaches end 104A. Piston 84B will thus have an opportunity to traverse 100% of cylinder 86B when travelling back toward end 102B before piston 84A reaches end 104A. However, to synchronize piston 84A and 84B for synchronous operation, synchronization logic of MCM 42B will have to reverse the direction of piston 84B, or point in the opposite direction prior to the start of the dispense, so pistons 84A and 84B will be moving in the same direction.

FIG. 5 shows starting positions for pistons 84A and 84B of linear pumps 24A and 24B where pistons 84A and 84B are pointing in opposite directions in opposite zones of cylinders 86A and 86B. For this scenario, at least one of pistons 84A and 84B is not within central zone 100A or 100B, respectively. Configured as such, the pistons are already arranged for anti-synchronous operation. However, in order to synchronize the pistons for synchronous operation, several steps are needed, as shown in FIGS. 6A-6C.

FIGS. 6A-6C show a synchronizing procedure for synchronous starting of pumps having pistons pointing in opposite directions in different zones of the pumps, as shown in FIG. 5. FIG. 6A is the same as FIG. 5, showing piston 84A within central zone 100A and moving up, while piston 84B is near end 104B (outward of central zone 100B) and moving down. FIG. 6A thus shows pistons 84A and 84B in start-up positions. The pumps set-up for movement in opposite "long" directions by pre-dispense logic. The pumps continue to move toward each other until they cross paths, e.g. are at the same position within cylinders 86A and 86B, as shown in FIG. 6B. At such point the faster moving piston executes a reversal of direction. As shown, MCM 42B issues a synch reversal command SR to piston 84B to move piston 84B in the upward direction using synchronizing logic. Thus, the faster piston will reach the end of its cylinder when the slower piston is in position to traverse its cylinder without meeting an end. Specifically, faster moving piston 84B will reach end 104B when piston 84A is between end 104A and central zone 100A such that piston 84B will be able to travel all the way back to end 102B without piston 84A hitting either of ends 102A and 104A. FIG. 6C shows the locations of the pistons when piston 84B arrives at end 104B. At such point, MCM 42A and MCM 42B issue normal reverse commands NR for reversals of direction for both pistons using control logic. Thus, piston 84B is in position to use all of cylinder 86B without being interrupted by piston 84A hitting end 102A, thereby increasing stroke length.

After any startup synchronizing procedures are executed, pistons 84A and 84B will oscillate between their respective ends of cylinders 86A and 86B. MCM 42A and MCM 42B monitor the positions of pistons 84A and 84B when reversals occur to verify that each is moving in the proper direction relative to each other for synchronous and anti-synchronous operation. For each operation, the MCMs monitor movements to verify if the faster-moving piston is maximizing its travel distance. If the MCMs detect that the faster-moving piston is not maximizing its travel distance, it will readjust the faster piston. For example, if the faster-moving piston is moving twice as fast, it should be able to use nearly 100% of its cylinder, while the other piston traverses only 50% of its cylinder between the ends. In one embodiment, the faster-moving piston should use at least about 85% of its cylinder when travelling twice as fast as the other piston to maximize efficiency. As discussed above, due to normal operation of pump system 10, the positions of pistons 84A and 84B become misaligned with respect to efficient operation. It is therefore desirable to re-synchronize their positions for synchronous or anti-synchronous operation. For example, if slower piston 84A reaches end 102A or 104A of cylinder 86A when piston 84B is within 15% of the length of cylinder 86B of end 102B or 104B, the synchronizing logic will be initiated by MCM 42A and MCM 42B. Different procedures are needed for re-synchronizing pistons in synchronous and anti-synchronous operation. FIGS. 7A-7G show re-synchronizing operations for synchronous operation. FIGS. 8A-8F show re-synchronizing operations for anti-synchronous operation.

Figure 7A:
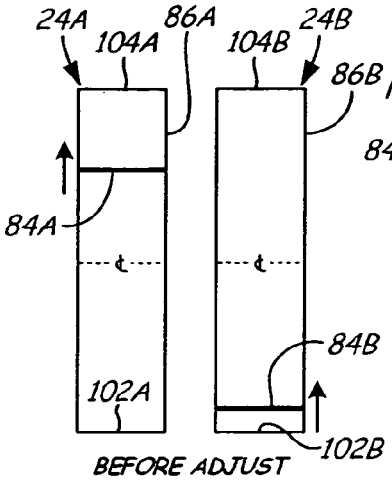
FIGS. 7A-7G show synchronizing procedures for adjustment of pumps that have drifted out of synchronous operation.
Figure 7B:
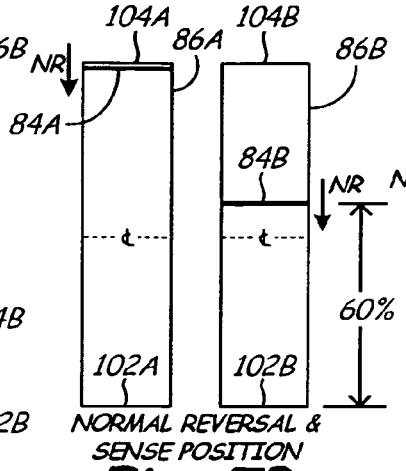
Figure 7C:
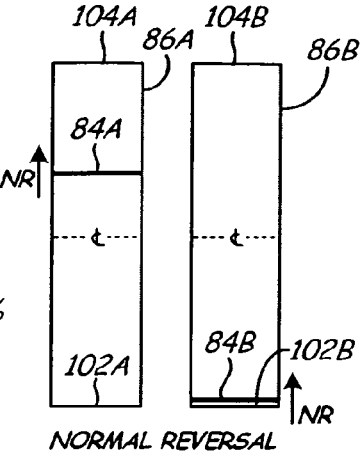
Figure 7D:
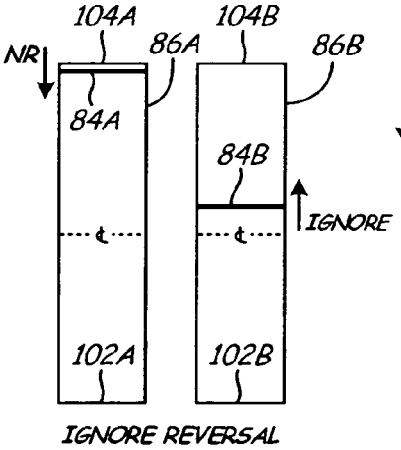
Figure 7E:
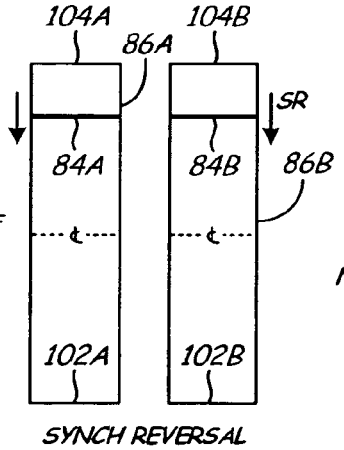
Figure 7F:
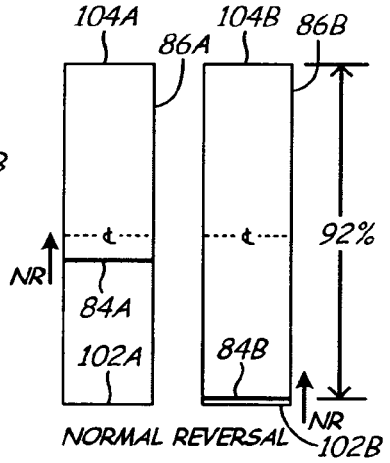
Figure 7G:
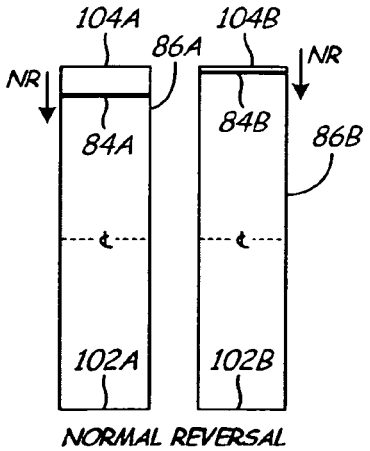

FIGS. 7A-7G show synchronizing procedures for adjustment of pistons 84A and 84B that have drifted out of synchronous operation. FIGS. 7A-7G present the steps executed to bring pistons 84A and 84B back to efficient synchronous operation. Piston 84B travels at speeds twice as fast as that of piston 84A for the embodiment disclosed, although the procedures outlined in FIGS. 7A-7G is applicable to any piston pair traveling at different or the same speeds. In FIG. 7A, piston 84A is moving in an upward "short" direction near end 104A, while piston 84B is moving in an upward "long" direction near end 102B before synchronizing adjustments occurs. FIG. 7B shows the positions of pistons 84A and 84B where the next control logic normal reverse commands NR are issued. Piston 84A reaches end 104A of cylinder 86A, causing MCM 42B to reverse direction of piston 84B. However, at such point, MCM 42B senses that piston 84B has only about 60% of effective travel in cylinder 86B, which provides MCM 42B with an indication that piston 84B has reversed prematurely. As such, in FIG. 7C, the pistons return to substantially similar positions as in FIG. 7A where they are out of position for efficient operation. FIG. 7C results in the control logic issuing additional normal reverse commands NR. Subsequently, however, rather than again executing the reverse command as in FIG. 7B, in FIG. 7D, when piston 84A reaches end 104A, MCM 42B uses synchronizing logic to issue an ignore command to reversing valve 48B, overruling or ignoring the control logic command for reversal of piston 84B. Subsequently, MCM 42B will reverse the direction of piston 84B by reversing reversing valve 48B again when the pistons cross paths, i.e. are at the same or equivalent position along cylinders 86A and 86B, as shown in FIG. 7E. In FIG. 7E, both pistons are traveling in the downward direction, with equal amounts of cylinders 86A and 86B remaining to be traversed after the synch reversal command SR is issued to piston 84B. Piston 84B will reach end 102B before piston 84A reaches end 102A due to the speed differential. When piston 84B reaches end 102B, MCM 42A and 42B issues normal reverse commands NR to pistons 84A and 84B to reverse direction using control logic as shown in FIG. 7F. At such point, piston 84B is in position so to be able to traverse nearly the entirety of cylinder 86B before piston 84A reaches end 104A. In the embodiment shown, piston 84B is setup to use nearly 100% of cylinder 86B. As shown in FIG. 7G, piston 84B reaches end 104B before piston 84A reaches end 104A and additional normal reverse commands NR are issued.

Thus, the synchronizing logic "pulls" piston 84A toward the center of cylinder 86A to enable piston 84B to maximize cylinder 86B. Hence, the travel of piston 84B in cylinder 86B will be the determining factor for pump reversals after the correction process. From the positions shown, piston 84B will be able to travel all the way to end 102B before piston 84A reaches end 102A, thus enabling piston 84B to maximize travel distance or stroke of cylinder 86B. As such, pistons 84A and 84B can continue in efficient synchronous operation for an extended period of time. The synchronizing logic of MCM 42A and 42B, however, continuously monitors and re-adjusts the positions of piston 84A and 84B to maintain efficient operation.

Figure 8A:
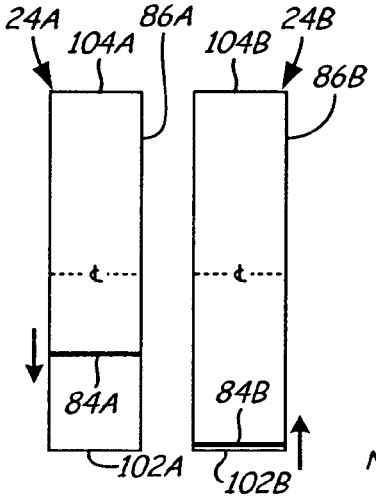
FIGS. 8A-8F show synchronizing procedures for adjustment of pumps that have drifted out of anti-synchronous operation.
Figure 8B:
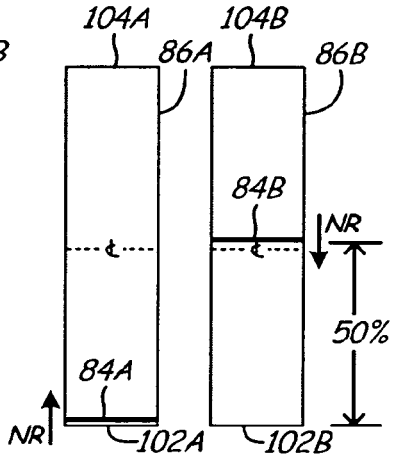
Figure 8C:
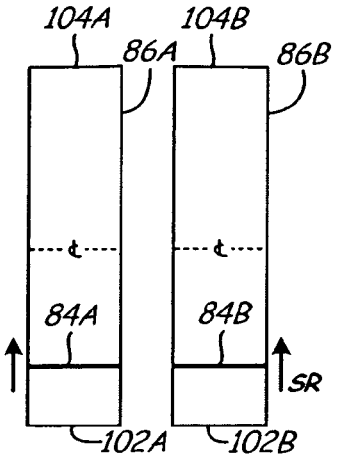
Figure 8D:
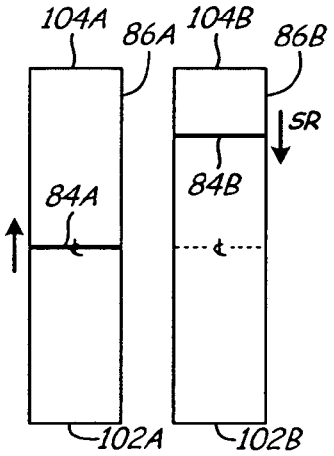

FIGS. 8A-8F show synchronizing procedures for adjustment of pistons 84A and 84B that have drifted out of anti-synchronous operation. FIGS. 8A-8F present the steps executed to bring pistons 84A and 84B back to efficient anti-synchronous operation. Piston 84B travels at speeds twice as fast as that of piston 84A for the embodiment disclosed, although the procedures outlined in FIGS. 8A-8F is applicable to any piston pair traveling at different or the same speeds. In FIG. 8A, piston 84A is moving in a downward "short" direction near end 102A, while piston 84B is moving in an upward "long" direction near end 102B before synchronizing adjustments occurs. FIG. 8B shows the positions of pistons 84A and 84B where the next control logic normal reverse commands NR are issued before synchronizing occurs. Piston 84A reaches end 104A of cylinder 86A, causing MCM 42A to reverse direction of piston 84A and MCM 42B to reverse direction of piston 84B. However, MCM 42B senses that piston 84B has only traveled about 50% of cylinder 86B, which provides MCM 42B with an indication that piston 84B has reversed prematurely. As such, in FIG. 8C, MCM 42B issues a synch reversal command SR to piston 84B under operation of synchronizing logic. This reverses the direction of piston 84B when the pistons cross paths, i.e. are at the same positions along cylinders 86A and 86B. Thus, both pistons are moving in the "long" direction at the same location in FIG. 8C. In FIG. 8D, MCM 42B issues another synch reversal command SR to piston 84B to again reverse the direction of piston 84B when piston 84A is in the center, or 50%, position so that both pistons are moving in opposite directions after the reverse.

Figure 8E:
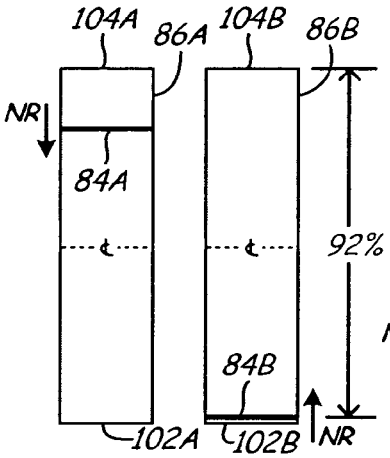
Figure 8F:
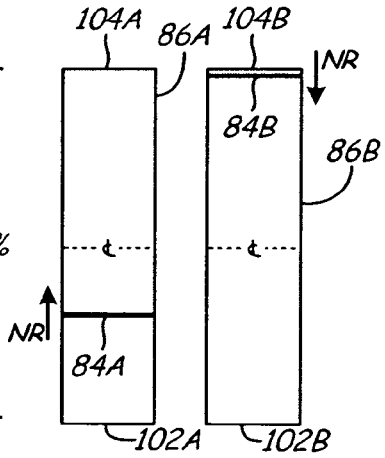

FIG. 8E and FIG. 8F show pistons 84A and 84B operating in anti-synchronous operation with normal reverse commands NR being issued to both pistons. In FIG. 8E, piston 84B is shown reaching end 102B, at which point piston 84A is reversed at a position that permits piston 84B to again travel nearly the entirety of cylinder 86B. In the embodiment shown, piston 84B is setup to use nearly 100% of cylinder 86B. FIG. 8F shows piston 84B having traversed all of cylinder 86B, again leaving piston 84A near the center of cylinder 86A when it reverses direction. Piston 84B is then again setup to use nearly the entirety of cylinder 86B. Again, the synchronizing logic "pulls" piston 84A toward the center of cylinder 86A to enable piston 84B to maximize cylinder 86B. As such, pistons 84A and 84B can continue in efficient anti-synchronous operation for an extended period of time. The synchronizing logic of MCM 42A and 42B, however, continuously monitors and re-adjusts the positions of piston 84A and 84B to maintain efficient operation.

Figure 9A:
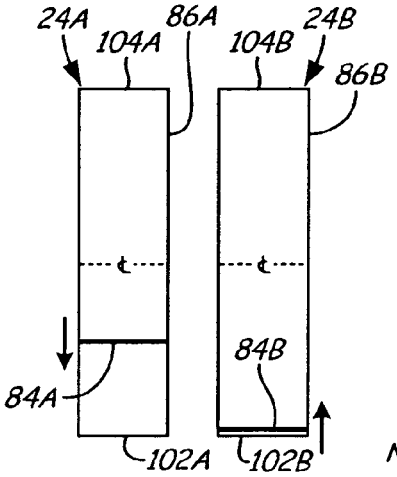
FIGS. 9A-9F show procedures for converting anti-synchronous operation of pumps to synchronous operation.
Figure 9B:
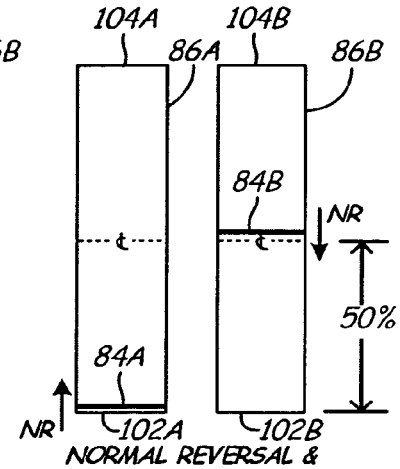
Figure 9C:
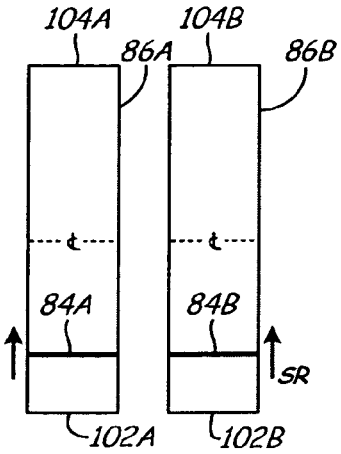
Figure 9D:
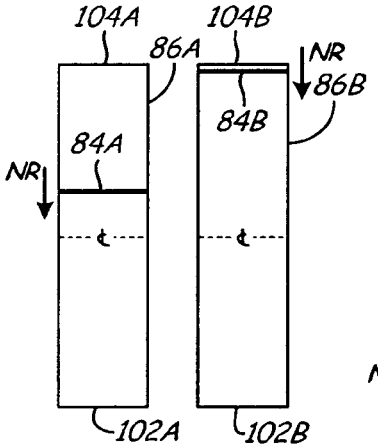
Figure 9E:
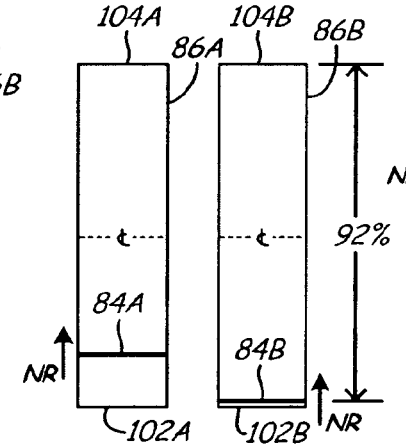
Figure 9F:
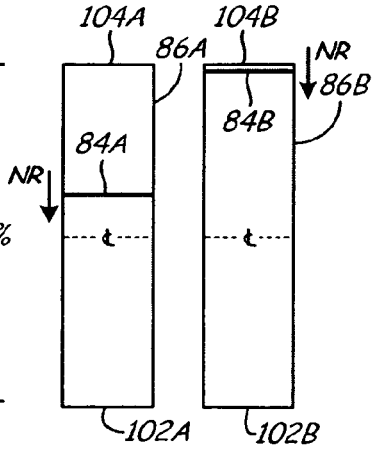

FIGS. 9A-9F show a procedure for converting inefficient anti-synchronous operation of pumps 24A and 24B to efficient synchronous operation. FIGS. 9A and 9B are similar to FIGS. 8A and 8B, illustrating that piston 84B is utilizing only about 50% of cylinder 86B before the adjustment occurs and the issuance of normal reverse commands NR. Upon sensing of this problem by MCM 42B in FIG. 9B, MCM 42B utilizes synchronizing logic to issue a synch reversal command SR to piston 84B in FIG. 9C, which is similar to FIG. 8C. MCM 42B uses synchronizing logic to reverse the direction of piston 84B when piston 84A and piston 84B cross paths, i.e. are at the same or equivalent position along cylinders 86A and 86B. At this point, MCM 42B, however, utilizes synchronizing logic to adjust operation of piston 84A and 84B into synchronous operation, as shown in FIGS. 9D-9F, rather than anti-synchronous operation, as shown in FIGS. 8D-8F.

FIG. 9D shows the issuance of the first control logic synch reversal command SR after adjustment by synchronizing logic. From the positions of FIG. 9C, pistons 84A and 84B travel toward ends 104A and 104B, respectively, at different rates of speed until piston 84B reaches end 104B. At such point, piston 84A is somewhere between centerline CL and end 104A, as shown in FIG. 9D. The direction of both pistons is reversed by control logic for travel towards ends 102A and 102B by the issuance of normal reverse commands NR. FIG. 9E shows the positions of pistons 84A and 84B when piston 84B reaches end 102B. Again, piston 84A is somewhere between centerline CL and end 102A. Piston 84B is however, setup to use nearly 100% of cylinder 86B. Control logic again issues normal reverse commands NR and reverses direction of both pistons from the positions of FIG. 9E to FIG. 9F. As such, pistons 84A and 84B can continue in efficient synchronous operation for an extended period of time. As discussed above, pistons 84A and 84B will gradually become out of position for efficient operation of system 10. The synchronizing logic of MCM 42A and 42B, however, continuously monitors and re-adjusts the positions of piston 84A and 84B to maintain efficient operation.

The present invention provides a system and method for initiating operation of pistons in a linear pump system having at least two pistons, synchronizing operation of the pistons for synchronous and anti-synchronous operation, monitoring the positions of the pistons, adjusting the reciprocation of the pistons to maintain efficient synchronous and anti-synchronous operation, and converting one operational mode to the other. Linear pump systems inherently produce lag and lead in movement of pistons within the linear pumps due to the need to reverse the piston direction. For example, the speed of each piston has to be adjusted during an up-stroke and a down-stroke due to differences in effective piston surface area between an up-stroke and a down-stroke. These continuous adjustments can gradually misalign the positions of the pistons, requiring synchronous, or anti-synchronous, re-adjustment. For a 2:1 dispense ratio it is generally desirable that the faster moving piston be able to travel at least 85% of its cylinder before a piston engages an end of its cylinder, thus avoiding a premature reversal by control logic. The present invention utilizes synchronizing logic to advantageously maintain position and speed of the pistons, relative to each other and ends of their cylinders, to maintain efficient operation.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method for synchronizing pistons within linear pumps, the method comprising:

operating first and second pistons to continuously reciprocate within first and second cylinders respectively, so that the first piston moves at a slower speed than the second piston;

controlling the first and second pistons to reverse direction whenever either one of the pistons reaches an end of its respective cylinder;

controlling the second piston so that it does not reverse direction when the first piston reaches the end of the first cylinder and the second piston has not traveled a desired length of the second cylinder; and selectively reversing the direction of one of the first and second pistons when neither is at an end of its respective cylinder to adjust synchronicity of the pistons.

2. The method of claim 1 and further comprising:

using a first motor control module which uses control logic to operate the first linear pump to reciprocate the first piston in the first cylinder between first and second ends spaced from a first midpoint;

using a second motor control module which uses control logic to operate the second linear pump to reciprocate the second piston in the second cylinder between third and fourth ends spaced from a second midpoint;

wherein the first and second control modules execute control logic to reverse direction of the first and second pistons whenever one piston reaches an end of its respective cylinder; and wherein the first and second control modules execute synchronizing logic to reverse direction of one of the first and second pistons before either piston reaches an end of its respective cylinder.

3. The method of claim 2 wherein the linear pumps are continuously reciprocated from starting positions such that the pistons are moving from a standstill after the control modules execute pre-dispense logic to coordinate movement of the first and second pistons in long directions before reversing the direction of one of the first and second pistons.

4. The method of claim 3 wherein:

the first motor control module determines a first distance that is the greater of the two distances between the first piston and the first and second ends of the first cylinder;

the second motor control module determines a second distance that is the greater of the two distances between the second piston and the third and fourth ends of the second cylinder;

moving the first piston in a direction of the first distance; and moving the second piston in a direction of the second distance.

5. The method of claim 3 wherein:

the first and second pistons move in the same direction from the start-up positions; and the step of reversing comprises:

reversing direction of the first piston before the second piston reaches an end of the second cylinder.

6. The method of claim 3 wherein:

the first and second pistons move in opposite directions toward each other from within central zones in their respective cylinders from the start-up positions; and the step of reversing comprises:

reversing direction of the second piston before the second piston reaches an end of the second cylinder.

7. The method of claim 3 wherein:

the first and second pistons move in opposite directions toward each other from the start-up positions; and the step of reversing comprises:

reversing direction of one of the first and second pistons whenever the first and second pistons are located at equivalent positions within the first and second cylinders, respectively.

8. The method of claim 7 wherein the step of reversing the direction of one of the first and second pistons whenever the first and second pistons are located at equivalent positions comprises reversing direction of the second piston such that both pistons travel in the same direction.

9. The method of claim 8 wherein one of the first and second pistons is not within a central zone of its respective cylinder from the start-up position.

10. The method of claim 2 wherein the linear pumps are in synchronous operation and the use of synchronizing logic is not required.

11. The method of claim 10 and further comprising:

reversing direction of movement for the first piston only when the first piston engages an end of the first cylinder; and reversing direction of the second piston whenever the first and second pistons are located at equivalent positions within the first and second cylinders, respectively;

wherein the pistons are operating in synchronous operation such that the pistons move in the same direction during operation.

12. The method of claim 11 wherein the second motor control module ignores a reverse command issued by the first motor control module when only the first piston's direction of movement is being reversed.

13. The method of claim 10 and further comprising:

reversing the directions of movement for the second and first pistons when the first piston engages an end of the first cylinder;

reversing direction of the second piston whenever the first and second pistons are located at equivalent positions within the first and second cylinders, respectively; and reversing direction of the second piston when the first piston is at the first midpoint of the first cylinder;

wherein the pistons are operating in anti-synchronous operation wherein the pistons are moving in opposite directions.

14. The method of claim 10 and further comprising:

reversing directions of movement for the second and first pistons when the first piston engages an end of the first cylinder;

reversing direction of movement for the second piston only when the first and second pistons are located at equivalent positions within the first and second cylinders, respectively; and reversing direction of the first and second pistons when either the first or second piston reaches an end of the first or second cylinder, respectively;

wherein pistons are operating in a conversion operation to convert anti-synchronous operation to synchronous operation.

15. The method of claim 2 wherein the first and second motor control modules monitor the positions of the first and second pistons to determine their locations at reversals.

16. The method of claim 1 wherein the linear pumps comprise constant velocity pumps that produce double-action pumping and wherein the first and second pistons are not mechanically coupled to each other.

17. The method of claim 1 and further comprising:

first and second motor control modules that operate first and second pistons within first and second cylinders using control logic;

first and second linear hydraulic motors that drive the first and second pistons, respectively;

first and second rotary hydraulic pumps that provide a flow of fluid to drive the first and second linear hydraulic motors respectively;

first and second reversing valves that direct the flow of hydraulic fluid to the first and second linear motor to reciprocate the first and second linear motor respectively;

first and second electric motors that drive the first and second rotary hydraulic pumps, respectively;

wherein the first and second motor control modules are connected to the first and second linear hydraulic motors and the first and second electric motor, respectively.

18. The method of claim 2 wherein the synchronizing logic works to bring the first piston into movement in a long direction when the second piston is at an end of the second cylinder.

19. A method of synchronizing pistons within a linear pump system, the method comprising:

driving first and second pistons to continuously reciprocate within first and second cylinders respectively, so that the first piston moves at a slower speed than the second piston;

sensing position of the first and second pistons within the first and second cylinders, respectively;

controlling the first and second pistons to reverse direction whenever either one of the pistons reaches an end of its respective cylinder;

selectively reversing direction of one of the first and second pistons when neither piston is at an end of its respective cylinder to adjust synchronicity of the pistons;

controlling the second piston so that it does not reverse direction when the first piston reaches the end of the first cylinder if the second piston has not traveled a desired length of the second cylinder; and controlling change in direction of movement of the first and second pistons as a function of sensed position of both the first and second pistons and speeds of the first and second pistons using first and second motor control modules which use control logic.

20. The method of claim 19 wherein the step of controlling change in direction of movement of the first and second pistons further comprises comparing relative positions between the first and second pistons.

21. The method of claim 20 wherein the step of controlling change in direction of movement of the first and second pistons further comprises comparing which piston has a shorter distance to travel before reaching an end of its cylinder.

22. The method of claim 19 wherein the step of controlling change in direction of movement of the first and second pistons further comprises changing direction of movement of only one of the first and second pistons.

23. The method of claim 22 wherein the step of changing direction of movement of only one of the first and second pistons comprises:

changing direction of movement of the first piston only before the second piston reaches an end of the second cylinder.

24. The method of claim 22 wherein the step of changing direction of movement of only one of the first and second pistons comprises:

changing direction of movement of the second piston only before the first piston reaches an end of the first cylinder.

25. The method of claim 24 wherein the step of changing direction of the second piston only comprises:

reversing direction of the second piston when the first and second pistons are located at equivalent positions within their respective cylinders.

26. The method of claim 25 wherein the step of changing direction of the second piston only further comprises:

the second motor control module ignoring a reverse command issued by the first motor control module when the first piston reaches an end of the first cylinder.

27. The method of claim 25 wherein the step of changing direction of the second piston only further comprises:

again reversing the direction of the second piston when the first piston is at a center position of the first cylinder after reversing direction of the second piston.

* * * * *